US010810926B2

(12) United States Patent
Kim et al.

(10) Patent No.: US 10,810,926 B2
(45) Date of Patent: Oct. 20, 2020

(54) DISPLAY DEVICE AND METHOD FOR CORRECTING IMAGE OF DISPLAY DEVICE

(71) Applicant: Samsung Display Co., Ltd., Yongin, Gyeonggi-Do (KR)

(72) Inventors: So-Young Kim, Seoul (KR); Won-Chang Chung, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 14/601,700

(22) Filed: Jan. 21, 2015

(65) Prior Publication Data

US 2016/0086526 A1 Mar. 24, 2016

(30) Foreign Application Priority Data

Sep. 19, 2014 (KR) ..... 10-2014-0124711

(51) Int. Cl.
*G09G 3/20* (2006.01)
*G09G 3/00* (2006.01)

(52) U.S. Cl.
CPC ..... *G09G 3/2092* (2013.01); *G09G 3/007* (2013.01); *G09G 2320/046* (2013.01)

(58) Field of Classification Search
CPC ..... G09G 2320/046
See application file for complete search history.

(56) References Cited

U.S. PATENT DOCUMENTS 5,579,059 A * 11/1996 Jang ..... H04N 19/523 348/699
5,721,589 A * 2/1998 Murata ..... H04N 19/176 375/240.18
6,313,878 B1 * 11/2001 Jankowiak ..... G09G 5/003 315/368.17

(Continued)

FOREIGN PATENT DOCUMENTS

KR 10-2003-0032564 A 4/2003
KR 10-2006-0116529 A 11/2006

(Continued)

OTHER PUBLICATIONS

Dictionary.com, "adjacent," in Dictionary.com Unabridged. Source location: Random House, Inc. http://dictionary.reference.com/browse/adjacent, Nov. 18, 2011, p. 1.*

*Primary Examiner* — Patrick F Marinelli
(74) *Attorney, Agent, or Firm* — Lewis Roca Rothgerber Christie LLP

(57) ABSTRACT

A display device and a method for correcting an image of the display device are disclosed. In one aspect, the display device includes a display panel including a plurality of pixel lines configured to be selected as at least one of data insertion lines and data deletion lines. The display device also includes an image corrector configured to receive input image data, select the data insertion lines and data deletion lines when the input image data represents an image including a static image block, insert second image data corresponding to the data insertion lines into the input image data, (Continued)

and delete first image data corresponding to the data deletion lines from the input image data so as to generate corrected image data including a shifted static image block.

14 Claims, 10 Drawing Sheets

(56) References Cited

U.S. PATENT DOCUMENTS

| | | | | |
|---|---|---|---|---|
| 6,628,247 | B2 * | 9/2003 | Toffolo | G09G 3/007 345/31 |
| 9,799,264 | B2 | 10/2017 | Eom et al. | |
| 10,068,537 | B2 * | 9/2018 | Lee | G09G 3/3648 |
| 2003/0076332 | A1 | 4/2003 | Choi | |
| 2003/0210256 | A1 * | 11/2003 | Mori | G09G 3/3233 345/690 |
| 2004/0258312 | A1 * | 12/2004 | Sim | G09G 3/298 382/219 |
| 2005/0093850 | A1 * | 5/2005 | Mori | G09G 3/007 345/204 |
| 2006/0001601 | A1 * | 1/2006 | Ono | G09G 3/007 345/60 |
| 2006/0220544 | A1 * | 10/2006 | Okuyama | B82Y 10/00 313/506 |
| 2008/0111886 | A1 * | 5/2008 | Bai | G09G 3/20 348/173 |
| 2011/0043551 | A1 * | 2/2011 | Kikuta | G09G 3/3233 345/691 |
| 2018/0012530 | A1 * | 1/2018 | Lee | G09G 3/007 |
| 2018/0033404 | A1 * | 2/2018 | Lee | G09G 5/18 |
| 2019/0371223 | A1 * | 12/2019 | Chun | G09G 3/2092 |

FOREIGN PATENT DOCUMENTS

| | | | |
|---|---|---|---|
| KR | 10-2007-0010710 | A | 1/2007 |
| KR | 10-2008-0042997 | A | 5/2008 |
| KR | 10-2009-0090657 | A | 8/2009 |
| KR | 10-2012-0106558 | A | 9/2012 |
| KR | 10-2014-0049277 | A | 4/2014 |

* cited by examiner

DISPLAY DEVICE AND METHOD FOR CORRECTING IMAGE OF DISPLAY DEVICE

CROSS-REFERENCE TO RELATED APPLICATIONS

This application claims priority from and the benefit of Korean Patent Applications No. 10-2014-0124711, filed on Sep. 19, 2014 in the Korean Intellectual Property Office (KIPO), the disclosure of which is hereby incorporated by reference herein in its entirety.

BACKGROUND

Field

The described technology generally relates to display devices and methods for correcting images of the display device.

Description of the Related Technology

In display devices such as organic light-emitting diode (OLED) displays, liquid crystal displays (LCDs), plasma display devices, etc., when the same image (or static image block) having high-luminance is displayed for some time in the same region of a display panel, an afterimage can remain in the region and pixels in the region can degrade.

SUMMARY OF CERTAIN INVENTIVE ASPECTS

One inventive aspect is a display device that can prevent an afterimage and distortions of an original image.

Another aspect is a method for correcting image of the display device.

Another aspect is a display device that can comprise a display panel including a plurality of pixel lines extending in a first direction, each of the pixel lines having a plurality of pixels, an image correction unit configured to receive input image data, to select a plurality of data insertion lines and a plurality of data deletion lines from the pixel lines when the input image data represent an image including a static image block, and to generate corrected image data to shift the static image block by inserting second image data corresponding to the data insertion lines into the input image data and by deleting first image data corresponding to the data deletion lines from the input image data, at least two of the data insertion lines being spaced apart from each other, and at least two of the data deletion lines being spaced apart from each other, a scan driver configured to provide a scan signal to the display panel, a data driver configured to provide a data signal corresponding to the corrected image data to the display panel, and a timing controller configured to control the scan driver and the data driver.

In example embodiments, shift amounts of the respective pixel lines is determined according to locations of the data insertion lines and the data deletion lines.

In example embodiments, the number of the data deletion lines is the same as the number of the data insertion lines.

In example embodiments, the image correction unit selects first to (k)th data insertion lines and first to (k)th data deletion lines where the k is an integer greater than 1. The first to (k)th data insertion lines and first to (k)th data deletion lines can be arranged in order. A shift region in the display panel can be between the first insertion line and the (k)th deletion line.

In example embodiments, the static image block is located between the data insertion lines and the data deletion lines.

In example embodiments, a shift amount of the static image block corresponds to the number of the data insertion lines.

In example embodiments, the data insertion lines is located outside of the static image block and at least one of the data deletion lines are overlapped in the static image block.

In example embodiments, the display panel includes a first region having the data insertion lines and a second region having the data deletion lines. A shift direction of the static image block can correspond to a direction from the first region to the second region.

In example embodiments, the image correction unit includes a memory configured to store the input image data from an external device, a static image detector configured to detect the static image block among the image based on the input image data accumulated within a predetermined time, a determiner configured to select the data insertion lines and the data deletion lines based on the location of the static image block, and a corrected image data generator configured to delete the first image data, to generate inserted image data of the second image data, and to generate the corrected image data by rearranging the input image data to shift the static image block in a direction from the first region to the second region based on the inserted image data.

In example embodiments, the respective inserted image data is generated by copying the input image data corresponding to the data insertion lines.

In example embodiments, the determiner periodically determines a direction of the data insertion lines, the number of the data insertion lines, and distances between the respective data insertion lines, and determine a direction of the data deletion lines, the number of the data deletion lines, and distances between the respective data deletion lines.

In example embodiments, the first direction corresponds to a direction in which a data line transmitting the data signal is extended.

In example embodiments, the first direction corresponds to a direction in which a scan line transmitting the scan signal is extended.

In example embodiments, the image correction unit is included in the timing controller, or is connected to the timing controller.

Another aspect is a method for correcting image of a display device that comprises receiving an input image data from an external device, detecting a static image block among an image displayed on a display panel based on the input image data that is accumulated within a predetermined time, determining a plurality of data insertion lines and a plurality of data deletion lines among a plurality of pixel lines extending in a first direction included in the display panel when the static image block is detected, deleting first image data corresponding to the data deletion lines from the input image data and generating inserted image data of second image data corresponding to the data deletion lines from the input image data, at least two of the data insertion lines being spaced apart from each other, and at least two of the data deletion lines being spaced apart from each other, outputting corrected image data by rearranging the input image data to shift the static image block based on the inserted image data, and displaying a corrected image having a shifted static image block on the display panel based on the corrected image data.

In example embodiments, the display panel includes a first region having the data insertion lines and a second region having the data deletion lines. A shift direction of the static image block can correspond to a direction from the first region to the second region.

In example embodiments, a shift amount of the static image corresponds to the number of the data insertion lines, and the number of the data insertion lines is the same as the number of the data deletion lines.

In example embodiments, determining the data insertion lines and the data deletion lines includes determining a direction of the data insertion lines, the number of the data insertion lines, and distances between the respective data insertion lines, and determining a direction of the data deletion lines, the number of the data deletion lines, and distances between the respective data deletion lines.

In example embodiments, the first direction corresponds to a direction in which a data line transmitting a data signal is extended.

In example embodiments, the first direction corresponds to a direction in which a scan line transmitting a scan signal is extended.

Another aspect is a display device, comprising a display panel including a plurality of pixel lines extending in a first direction, wherein each of the pixel lines includes a plurality of pixels, and wherein the pixel lines are configured to be selected as at least one of data insertion lines and data deletion lines. The display device also comprises an image corrector configured to i) receive input image data, ii) select the data insertion lines and data deletion lines when the input image data represents an image including a static image block, iii) insert second image data corresponding to the data insertion lines into the input image data, and iv) delete first image data corresponding to the data deletion lines from the input image data so as to generate corrected image data including a shifted static image block, wherein at least two of the data insertion lines are spaced apart from each other, and wherein at least two of the data deletion lines are spaced apart from each other. The display device further comprises a scan driver configured to provide a scan signal to the display panel, a data driver configured to provide a data signal corresponding to the corrected image data to the display panel, and a timing controller configured to control the scan driver and the data driver.

In the above display device, the image corrector is further configured to determine shift amounts of the static image block based at least in part on locations of the data insertion lines and the data deletion lines.

In the above display device, the number of the data deletion lines is the same as the number of the data insertion lines.

In the above display device, the image corrector is further configured to select first to (k)th data insertion lines and first to (k)th data deletion lines, where the k is an integer greater than 1, wherein the data insertion lines and the data deletion lines are arranged in order, and wherein an image shift region in the display panel is located between the first insertion line and the (k)th deletion line.

In the above display device, the static image block is located between the data insertion lines and the data deletion lines.

In the above display device, a shift amount of the static image block corresponds to the number of the data insertion lines.

In the above display device, the data insertion lines are located outside of the static image block, wherein at least one of the data deletion lines at least partially overlaps the static image block.

In the above display device, the display panel includes a first region having the data insertion lines and a second region having the data deletion lines, wherein a shift direction of the static image block extends from the first region to the second region.

In the above display device, the image corrector includes a memory configured to store the input image data from an external device, a static image detector configured to detect the static image block within the image based at least in part on the input image data after a predetermined time, and a determiner configured to select the data insertion lines and the data deletion lines based at least in part on the location of the static image block. In the above display device, the image corrector also includes a corrected image data generator configured to i) delete the first image data, ii) generate image data including the second image data, and iii) shift the static image block in the first direction based at least in part on the generated image data so as to output the corrected image data.

In the above display device, the corrected image data generator is further configured to copy the input image data corresponding to the data insertion lines so as to generate the image data.

In the above display device, the determiner is further configured to substantially periodically determine at least one of the following: a direction of the data insertion lines, a number of the data insertion lines, distances between the data insertion lines, a direction of the data deletion lines, a number of the data deletion lines, and distances between the data deletion lines.

In the above display device, the first direction corresponds to a direction in which a data line configured to transmit the data signal extends.

In the above display device, the first direction corresponds to a direction in which a scan line configured to transmit the scan signal extends.

In the above display device, the timing controller includes or is electrically connected to the image corrector.

Another aspect is a method for correcting an image to be displayed on a display device, comprising receiving input image data from an external device, detecting a static image block within an image displayed on a display panel based at least in part on the input image data after a predetermined period of time, and determining a plurality of data insertion lines and a plurality of data deletion lines from a plurality of pixel lines extending in a first direction included in the display panel when the static image block is detected. The method also comprises deleting first image data corresponding to the data deletion lines from the input image data, generating image data including second image data corresponding to the data deletion lines from the input image data, wherein at least two of the data insertion lines are spaced apart from each other, and wherein at least two of the data deletion lines are spaced apart from each other. The method further comprises rearranging the input image data to include a shifted static image block based at least in part on the generated image data so as to output corrected image data. The method additionally comprises displaying a corrected image having the shifted static image block on the display panel based at least in part on the corrected image data.

In the above method, the display panel includes a first region having the data insertion lines and a second region having the data deletion lines, wherein a shift direction of the static image block extends from the first region to the second region.

In the above method, a shift amount of the static image corresponds to a number of the data insertion lines, wherein the number of the data insertion lines is the same as a number of the data deletion lines.

In the above method, the i) determining includes determining a direction of the data insertion lines, a number of the data insertion lines, and distances between the data insertion lines and ii) determining a direction of the data deletion lines, a number of the data deletion lines, and distances between the data deletion lines.

In the above method, the first direction corresponds to a direction in which a data line, in the display device, transmitting a data signal extends.

In the above method, the first direction corresponds to a direction in which a scan line, in the display device, transmitting a scan signal extends.

According to at least one of the disclosed embodiments, the display device and the method for correcting image of the display device shift only a portion of the image including the static image block based on the selected data insertion lines and data deletion lines. In addition, the display device can control the shift direction and the shift amount of the static image by determining the locations of the data insertion lines and the data deletion lines. Thus, a problem that edge image of the whole screen is cut and distortion of the edge image by conventional image shift method can be improved. Further, the static image block is shifted in certain direction so that an afterimage and degradation of the pixels due to the repeat of the same image such as a logo, titles, etc., can be efficiently prevented.

DETAILED DESCRIPTION OF CERTAIN INVENTIVE EMBODIMENTS

When logos or subtitles having high luminance are displayed for a long time, degradation of the display panel can be accelerated. Generally, a method of shifting whole images displayed in a frame is applied to solve the afterimage problem. However, as the whole image is shifted in a certain direction, edge portions of an original image are distorted and not displayed.

Exemplary embodiments will be described more fully hereinafter with reference to the accompanying drawings, in which various embodiments are shown. In this disclosure, the term "substantially" includes the meanings of completely, almost completely or to any significant degree under some applications and in accordance with those skilled in the art. Moreover, "formed on" can also mean "formed over." The term "connected" can include an electrical connection.

Figure 1:
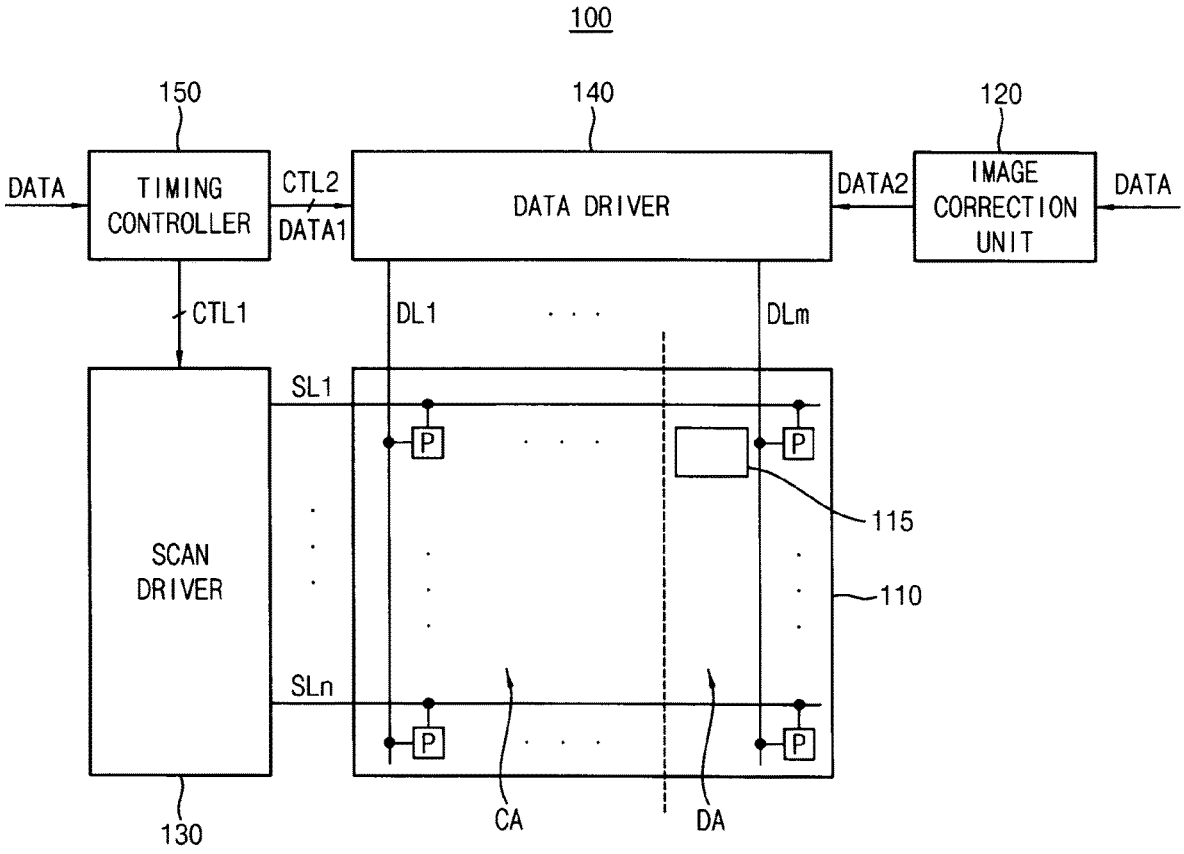
FIG. 1 is a block diagram of a display device according to example embodiments.

FIG. 1 is a block diagram of a display device according to example embodiments.

Referring to FIG. 1, the display device 100 includes a display panel 110, an image correction unit or corrector 120, a scan driver 130, a data driver 140, and a timing controller 150.

In some embodiments, the display device 100 is an OLED display having a plurality of OLEDs.

The display panel 110 includes a plurality of pixels P. The display panel 110 can be connected to the scan driver 130 through a plurality of scan lines SL1 through SLn, and can be connected to the data driver 140 through a plurality of data lines DL1 through DLm. The display panel 110 can includes M (M is a positive integer) of pixel columns each connected to the respective data lines DL1 through DLm and N (N is a positive integer) of pixel rows each connected to the respective scan lines SL1 through SLn. Thus, the pixels can be arranged in a matrix form and the display panel 110 can include N*M pixels. The display panel 120 can display an image based at least in part on an input image data DATA from an external image source or a corrected image data DATA2 which is generated by the image correction unit 120. The display panel 110 can display a static image block 115.

The display panel 110 can include a plurality of pixel lines extending in a first direction. Each of the pixel lines can have the pixels P. The display panel 110 can include a plurality of data insertion lines and a plurality of data deletion lines from the pixel lines when the input image data DATA represents an image including the static image block 115. The data insertion lines and the data deletion lines can correspond to certain pixel rows and/or columns. At least two of the data insertion lines can be spaced apart from each other, and at least two of the data deletion lines can be spaced apart from each other. In some embodiments, the first direction corresponds to a direction in which a data line transmitting the data signal is extended. In some embodiments, the first direction corresponds to a direction in which a scan line transmitting the data signal is extended.

The input image data DATA corresponding to the data insertion lines can be inserted (or copied) to generate inserted image data, and the input image data DATA corresponding to the data deletion lines can be deleted so that the input image data DATA2 can be rearranged to shift the static image block 115. The display panel 110 can include a first region CA having the data insertion lines and a second region DA having the data deletion lines. A shift direction of the static image block 115 can correspond to a direction from the first region CA to the second region DA. The corrected image data generator 128 can copy the input image data corresponding to the data insertion lines and generate the respective inserted image data.

First image data from the input image data DATA can correspond to the data deletion lines and second image data from the input image data DATA can correspond to the data insertion lines when the static image block 115 is not detected. The first image data can be deleted by the image correction unit 120 when the static image block 115 is detected. In some embodiments, the static image block 115 is located between the data insertion lines and the data deletion lines. In some embodiments, the data insertion lines is located outside of the static image block and at least one of the data deletion lines at least partially overlaps with the static image block.

The static image block 115 from the image based at least in part on the input image data DATA accumulated within or after a predetermined time. The static image block 115 can include a logo (e.g., a logo of a broadcasting company), a title of a TV program, a subtitle, etc. In some embodiments, the static image block 115 includes a pixel region to which high-luminance pattern image data are repeatedly applied over a predetermined time.

The second region DA can include the data insertion lines corresponding to certain pixel columns and/or rows. The second image data corresponding to the data insertion lines can be inserted (or copied) by the image correction unit 120 when the static image block 115 is detected.

Portions of an image displayed on the display panel 110 can be shifted to prevent an afterimage due to the repeat of the same image. In some embodiments, the static image block 115 among the whole image is shifted. The image correction unit 120 can generate corrected image data DATA2 to shift the static image block 115 by inserting the second image data corresponding to the data insertion lines into the input image data and by deleting the first image data corresponding to the data deletion lines from the input image data DATA. Shift amounts of the respective pixel lines are determined according to locations of the data insertion lines and the data deletion lines. In some embodiments, a shift amount of the static image block 115 corresponds to the number of the data insertion lines. For example, the static image block 115 is shifted in a certain direction by 30 pixels when the number of data insertion lines (or, the number of the data deletion lines) is 30. A direction of each data insertion line (or data deletion line) can correspond to a pixel row or a pixel column.

The image correction unit 120 can receive input image data. The image correction unit 120 can select the data insertion lines and the data deletion lines from the pixel lines when the input image data DATA represents an image including the static image block 115. The image correction unit 120 can generate corrected image data DATA2 to shift the static image block 115 by inserting the second image data corresponding to the data insertion lines into the input image data DATA and by deleting the first image data corresponding to the data deletion lines from the input image data DATA. Thus, the static image block 115 can be shifted in a certain direction. The image correction unit 120 can provide the corrected image data DATA2 to the data driver 140.

In some embodiments, the image correction unit 120 includes a memory storing an input image data DATA from an external device, and a static image detector detecting the static image block 115 among the image based at least in part on the input image data DATA accumulated within a predetermined time. In some embodiments, the image correction unit 120 also includes a determiner selecting the data deletion lines and the data insertion lines based at least in part on the location of the static image block 115, and corrected image data generator. In some embodiments, the corrected image data generator deletes the first image data, generates inserted image data of the second image data, and generates the corrected image data DATA2 by rearranging the input image data DATA to shift the static image block 115 in a direction from the second region DA to the first region CA based at least in part on the inserted image data. The static image block 115 can be shifted in a certain direction by the corrected image data DATA2.

In some embodiments, the image correction unit 120 is included in the timing controller 150, or is connected to the timing controller 150. Thus, the image correction unit 120 and the timing controller 150 can receive the same input image data DATA from the external image source.

The scan driver 130 provides a scan signal to the display panel 110 through the scan lines SL1 through SLn. In some embodiments, the scan lines SL1 through SLn are respectively connected to the pixel rows.

The data driver 140 provides a data signal to the display panel 110 through the data lines DL1 through DLm according to the scan signal. In some embodiments, the data driver 140 generates the data signal corresponding to the corrected image data DATA2 and provides the data signal to the display panel 110. In some embodiments, the data lines DL1 through DLm are respectively connected to the pixel columns.

The timing controller 150 respectively provides a plurality of control signals CTL1 and CTL2 to the scan driver 130 and the data driver 140, and controls the scan driver 130 and the data driver 140. The timing controller 150 can receive an input control signal and the input image data DATA from an image source such as an external graphic apparatus. The input control signal can include a main clock signal, a vertical synchronizing signal, a horizontal synchronizing signal, and a data enable signal. The timing controller 150 can generate digital image data DATA1 and corresponds to operating conditions of the display panel 110 based at least in part on the input image data DATA. In addition, the timing controller 150 can generate a first control signal CTL1 for controlling a driving timing of the scan driver 130, and a second control signal CTL2 for controlling a driving timing of the data driver 140. In some embodiments, the image correction unit 120 is included in the timing controller 150. In some embodiments, the image correction unit 120 is connected to the timing controller 150.

As described above, the display device 100 according to example embodiments selects the data insertion lines and the data deletion lines, and generates the corrected image data DATA2 to shift a portion of the whole image including the static image block 115. At least two of the data insertion lines can be spaced apart from each other, and at least two of the data deletion lines can be spaced apart from each other. In addition, the display device 100 can control the shift direction and the shift amount of the static image 115 by determining the locations of the data insertion lines and the data deletion lines. Thus, a problem where an edge of the image in the screen is cut and distortion of the edge image by typical image shift method can be improved. Further, the static image block 115 is shifted in some direction so that an afterimage and degradation of the pixels due to the repeat of the same image such as a logo, titles, etc., can be efficiently prevented.

Figure 2:
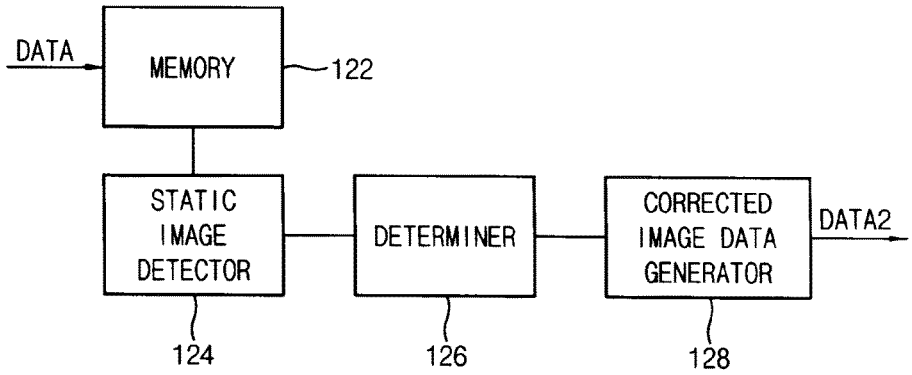
FIG. 2 is a block diagram illustrating an example of the image correction unit in the display device of FIG. 1.

FIG. 2 is a block diagram illustrating an example of the image correction unit 120 in the display device 100 of FIG. 1.

Referring to FIGS. 1 and 2, the image correction unit 120 includes a memory 122, a static image detector 124, a determiner 126, and a corrected image data generator 128. In some embodiments, the image correction unit 120 is in the timing controller 150 or connected to the timing controller 150.

The memory 122 can store an input image data DATA from an external device. The memory 122 can store input image data DATA by a frame unit. In some embodiments, the memory 122 stores lifetime information of each pixel based at least in part on the accumulated input image data DATA.

The static image detector 124 can detect the static image block 115 from the image based at least in part on the input image data DATA accumulated within a predetermined time. The static image block 115 can include a logo (e.g., a logo of a broadcasting company), a title of a TV program, a subtitle, etc. In some embodiments, the static image block 115 can include a pixel region where high-luminance pattern image data are repeatedly applied over a predetermined time. Here, in each pixel, the input image data DATA which is supplied to the frame is compared and it is determined whether the input image data DATA is repeated during a plurality of frames for each pixel. If the same image data DATA is supplied, the location information and the input image data DATA of certain portion of pixels (e.g., the static image block 115) where the input image data DATA is repeated among the pixels are stored to an assistance memory.

In some embodiments, the static image detector 124 compares the stored lifetime information of each pixel with a predetermined reference value. The static image detector 124 can detect a high-luminance static image block that has the lifetime information below the reference value. The high-luminance static image block 115 can include the logo, the title of the TV program, the subtitle, etc. The input image data DATA is repeated among the pixels are stored to an assistance memory.

The static image detector 124 can detect a plurality of static image blocks. For example, the logo of a broadcasting company and the title of the TV program can be substantially simultaneously detected as the static image blocks.

The determiner 126 can select the data deletion lines and the data insertion lines based at least in part on the location of the static image block 115. At least two of the data insertion lines can be spaced apart from each other, and at least two of the data deletion lines can be spaced apart from each other. In some embodiments, the determiner 126 further determines a period of time for determining whether the static image block. The determiner 126 can substantially periodically change locations of the data deletion lines and the data insertion lines such that a shift direction of the static image block 115 can be substantially periodically changed. For example, the static image block 115 is sequentially shifted in left, upper, right and lower directions at about 5-minute intervals by the operation of the determiner 126.

The display panel 110 can include a second region DA having the data deletion lines and a first region CA having the data insertion lines. In some embodiments, the shift direction of the static image block 115 corresponds to a direction from the first region CA to the second region DA.

In some embodiments, the determiner 126 substantially periodically determines a direction of the data insertion lines, the number of the data insertion lines, and distances between the respective data insertion lines. The determiner 126 can determine a direction of the data deletion lines, the number of the data deletion lines, and distances between the respective data deletion lines.

Each of the data deletion lines can correspond to a pixel column or a pixel row that receive the first image data among the input image data DATA. Gray-levels corresponding to the first image data can be displayed at the pixel column or the pixel row corresponding to the data deletion lines when an original image based at least in part on the input image data DATA is displayed on the display panel 110. The second region DA can include the data deletion lines that receive data signals corresponding to the first image data.

Similarly, each of the data insertion lines can correspond to a pixel column or a pixel row that receive the second image data among the input image data DATA. Gray-levels corresponding to the second image data can be displayed at the pixel column or the pixel row corresponding to the data deletion lines, when an original image based at least in part on the input image data DATA is displayed on the display panel 110. The first region CA can include the data insertion lines that receive data signals corresponding to the second image data.

Shift amounts of the respective pixel lines can be determined according to locations of the data insertion lines and the data deletion lines. The shift direction of the static image blocks 115 can depend on the locations and the arrangement directions of the data insertion lines and the data deletion lines.

The number of the data deletion lines can be the same as the number of the data insertion lines. Thus, the corrected image without data loss in each pixel can be displayed on the display panel 110. A shift amount (or a shifting amount) can be determined by the number of the data deletion lines and the number of the data insertion lines. For example, a portion of the whole image in one frame or the static image block 115 is shifted in a certain direction by about 80 pixels when the number of data deletion lines is about 80. The image shift is not visible.

In some embodiments, the operations of the determiner 126 is controlled by a user who uses a remote controller or a similar key entry unit (not shown).

The corrected image data generator 128 can delete the first image data, generate a inserted image data of the second image data, and generate the corrected image data DATA2 by rearranging the input image data DATA to shift the static image block 115 in a direction from the first region CA to the second region DA based at least in part on the inserted image data. For example, some image data is shifted by the inserted image so that certain shifted image data can be respectively applied to the data deletion lines. As a result, the input image data DATA can be rearranged to the corrected image data DATA2. The corrected image data generator 128 can provide the corrected image data DATA2 to the data driver 140. The corrected image having the static image block 115 which is shifted in a predetermined direction can be displayed on the display panel 110 based at least in part on the corrected image data DATA2.

Thus, a problem where an edge of the image in the screen is cut and distortion of the edge image can be improved. Further, an afterimage and degradation of the pixels due to the continuous display of the same image such as a logo, titles, etc., can be efficiently prevented.

Figure 3:
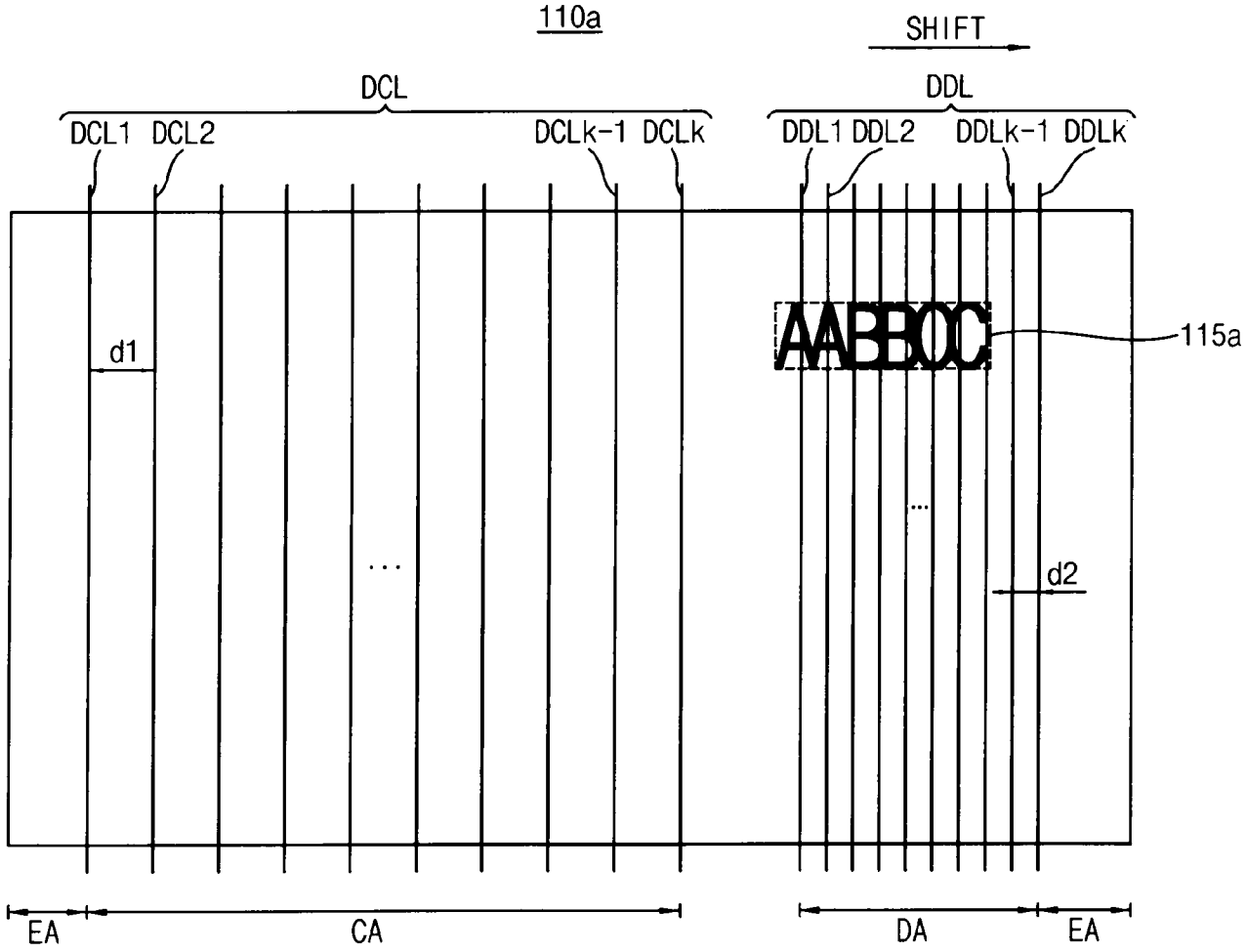
FIG. 3 is a diagram illustrating an example when a static image block is shifted in a horizontal direction by the image correction unit in the display device of FIG. 1.

FIG. 3 is a diagram illustrating an example that a static image block is shifted in a horizontal direction by the image correction unit 120 in the display device 100 of FIG. 1.

Referring to FIG. 3, the image correction unit 120 shifts the static image block 115*a* by certain number of pixels in a right direction.

The display panel 110*a* can include a first region CA having a plurality of data insertion lines DCL and a second region DA having a plurality of data deletion lines DDL. The static image block 115*a* can be included in the second region DA. The data insertion lines DCL and the data deletion lines DDL can be selected by the image correction unit 120.

The first region CA can include first through (k)th (k is a positive integer) data insertion lines DCL. In some embodiments, as illustrated in FIG. 3, each of the data insertion lines DCL corresponds to at least a portion of a pixel column that is connected to a data line included in the first region CA. The image correction unit 120 can generate inserted image data of second image data. The second image data can correspond to image data (or, data signal) that is applied to pixels corresponding to the data insertion lines DCL among the input image data DATA (or, an original image data). In addition, the image correction unit 120 can determine a direction of the data insertion lines DCL, the number of the data insertion lines DCL, and a distance between the data insertion lines DCL. For example, a distance d1 between the first data insertion line DCL1 and the second data insertion line DCL2 can be substantially the same to a distance between the (k−1)th data insertion line DCLk−1 and the (k)th data insertion lines DCLk. In contrast, respective distances between the data insertion lines DCL can be different. For example, at least one of the pixel lines is between the (k−1)th data insertion line DCLk−1 and the (k)th data insertion lines DCLk. In some embodiments, the image correction unit 120 selects the first to (k)th data insertion lines DCL1 through DCLk and the first to (k)th data deletion lines DDL1 through DDLk.

The second region DA can include first through (k)th data deletion lines DDL. In some embodiments, as illustrated in FIG. 3, each of the data deletion lines DDL corresponds to at least a portion of a pixel column that is connected to a data line included in the second region DA. The image correction unit 120 can delete first image data. The first image data can correspond to image data (or, data signal) that is applied to pixels corresponding to the data deletion lines DDL among the input image data DATA (or, an original image data). In addition, the image correction unit 120 can determine a direction of the data deletion lines DDL, the number of the data deletion lines DDL, and distances between the respective data deletion lines DDL. At least one of the pixel lines can be located between the respective data insertion lines DDL1 through DDLk. For example, a distance between the first and second data deletion lines DDL1 and DDL2 is substantially the same to a distance d2 between the (k−1)th and (k)th data deletion lines DDLk−1 and DDLk. In contrast, respective distances between the data deletion lines DDL can be different. The distance d1 between the first and second data insertion lines DCL1 and DCL2 can be substantially the same as the distance d2 between the (k−1)th and (k)th data deletion lines DDLk−1 and DDLk.

As illustrated in FIG. 3, the first to (k)th data insertion lines DCL1 through DCLk and first to (k)th data deletion lines DDL1 through DDLk are arranged in a certain order. A shift region that the image is shifted in the display panel 110*a* can be between the first insertion line DCL1 and the (k)th deletion line DDLk. For example, the image in the region between the first insertion line DCL1 and the (k)th deletion line DDLk is shifted. In some embodiments, outer regions of the shift region EA are not shifted. Thus, in some embodiments, edge images on the display panel 110*a* are not distorted.

The image correction unit 120 can rearrange the input image data DATA in a direction from the first region CA to the second region DA using the inserted image data. Thus, shifted data signals based at least in part on the rearranged image data can be applied to the pixels (e.g., pixel lines). As a result, the static image block 115*a* can be shifted. A shift direction of the static image block 115*a* can correspond to a direction from the first region CA to the second region DA. Thus, the static image block 115*a* can be shifted in the right direction. Shift amounts of the respective pixel lines can be determined according to locations of the data insertion lines DCL and the data deletion lines DDL. For example, the shift amounts of some pixel lines in the static image block 115*a* are different. In this, however, the maximum shift amount of the pixel line can be k-pixels. The number of the data deletion lines can be the same as the number of the data insertion lines. Thus, in some embodiments, the corrected image without data loss in each pixel is displayed on the display panel 110, and edge images on the display panel 110*a* are not distorted.

In some embodiments, the data insertion lines DCL are located outside of the static image block 115*a* and at least one of the data deletion lines DDL overlap the static image block 115*a*.

As illustrated in FIG. 3, the data deletion lines DDL and the data insertion lines DCL respectively correspond to pixel columns that are respectively connected to data lines when the static image block 115*a* is shifted in the horizontal direction of the display panel 110*a*.

Figure 4:
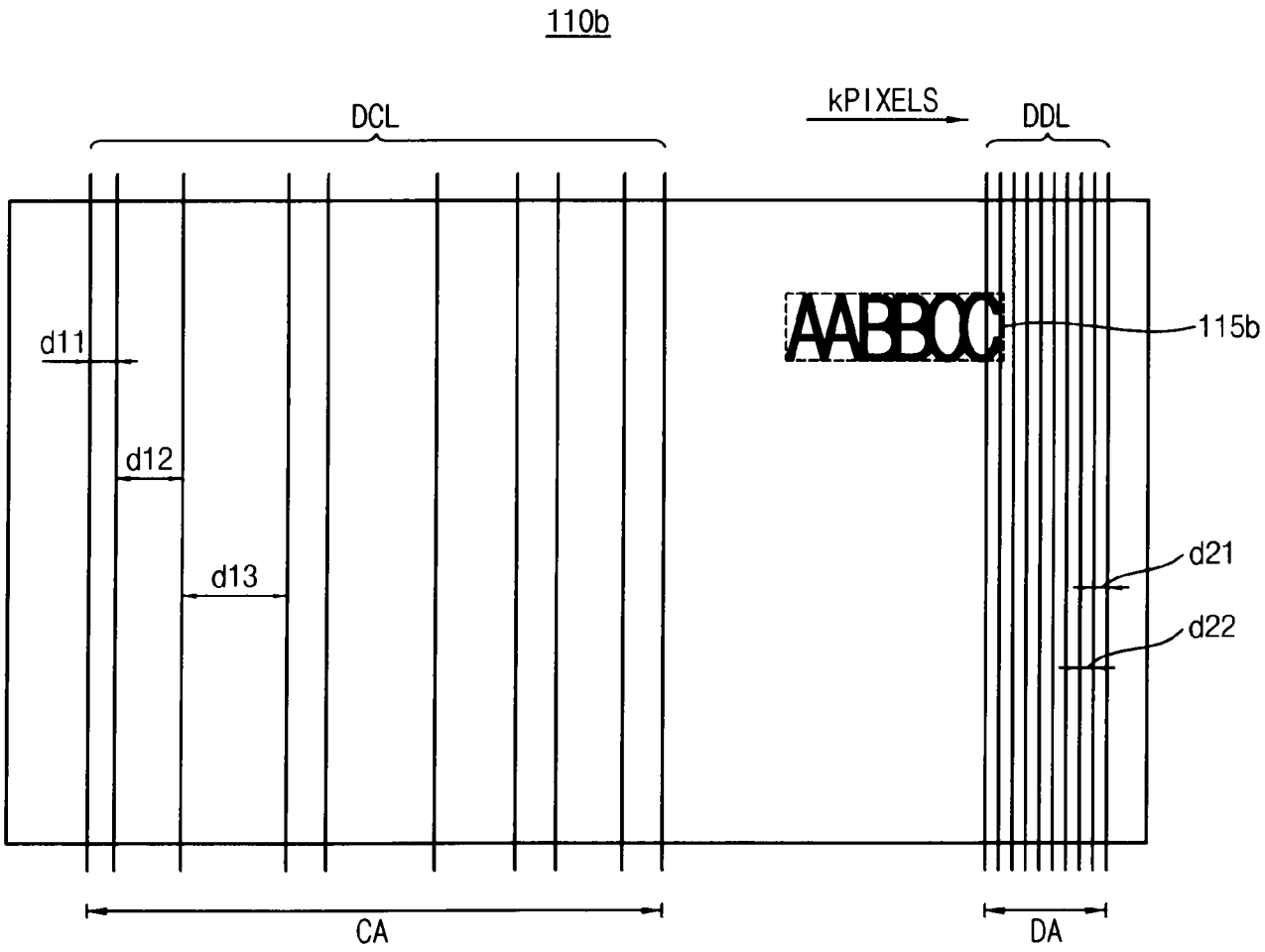
FIG. 4 is a diagram illustrating another example when a static image block is shifted in a horizontal direction by the image correction unit in the display device of FIG. 1.
Figure 5:
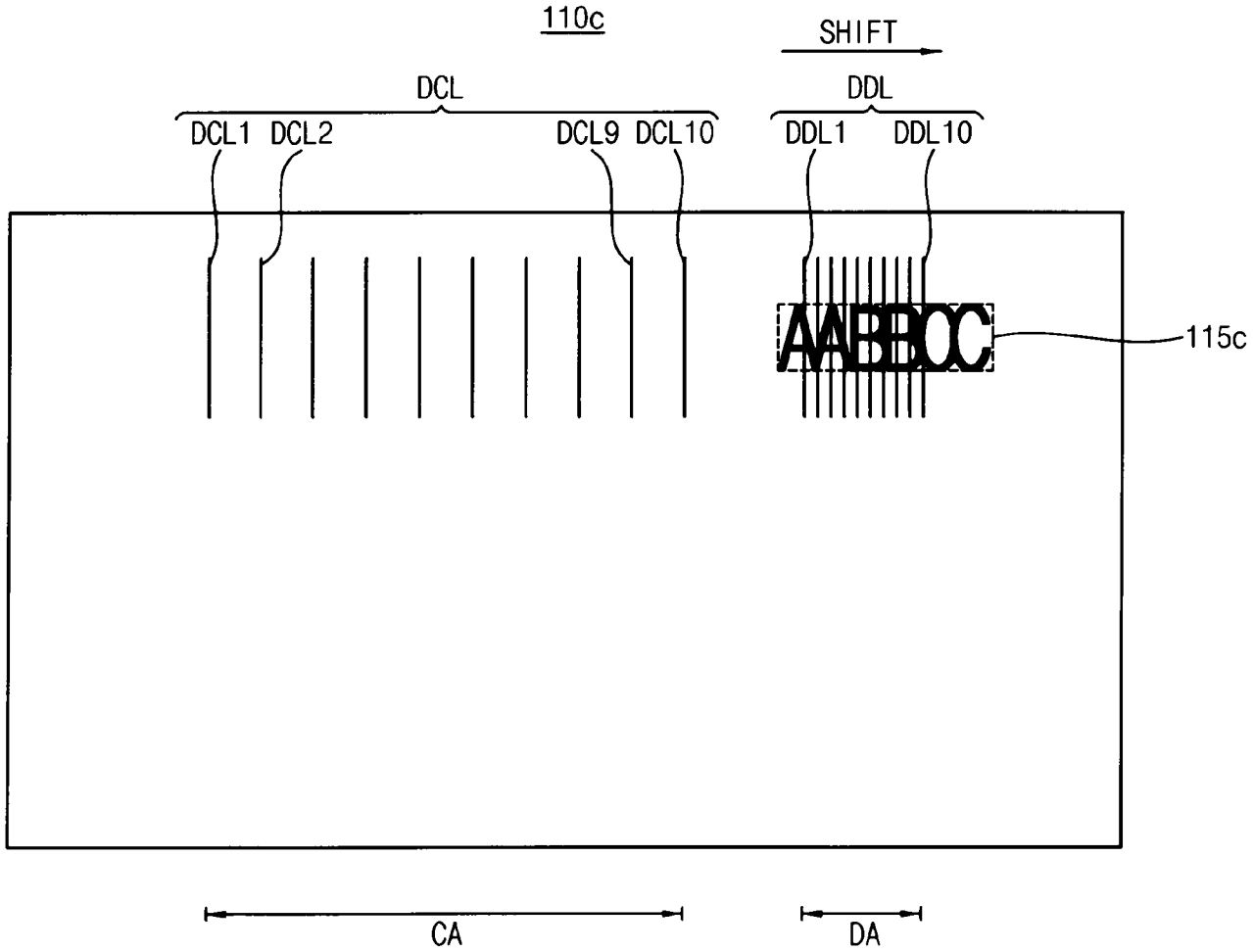
FIG. 5 is a diagram illustrating still another example when a static image block is shifted in a horizontal direction by the image correction unit in the display device of FIG. 1.
Figure 6:
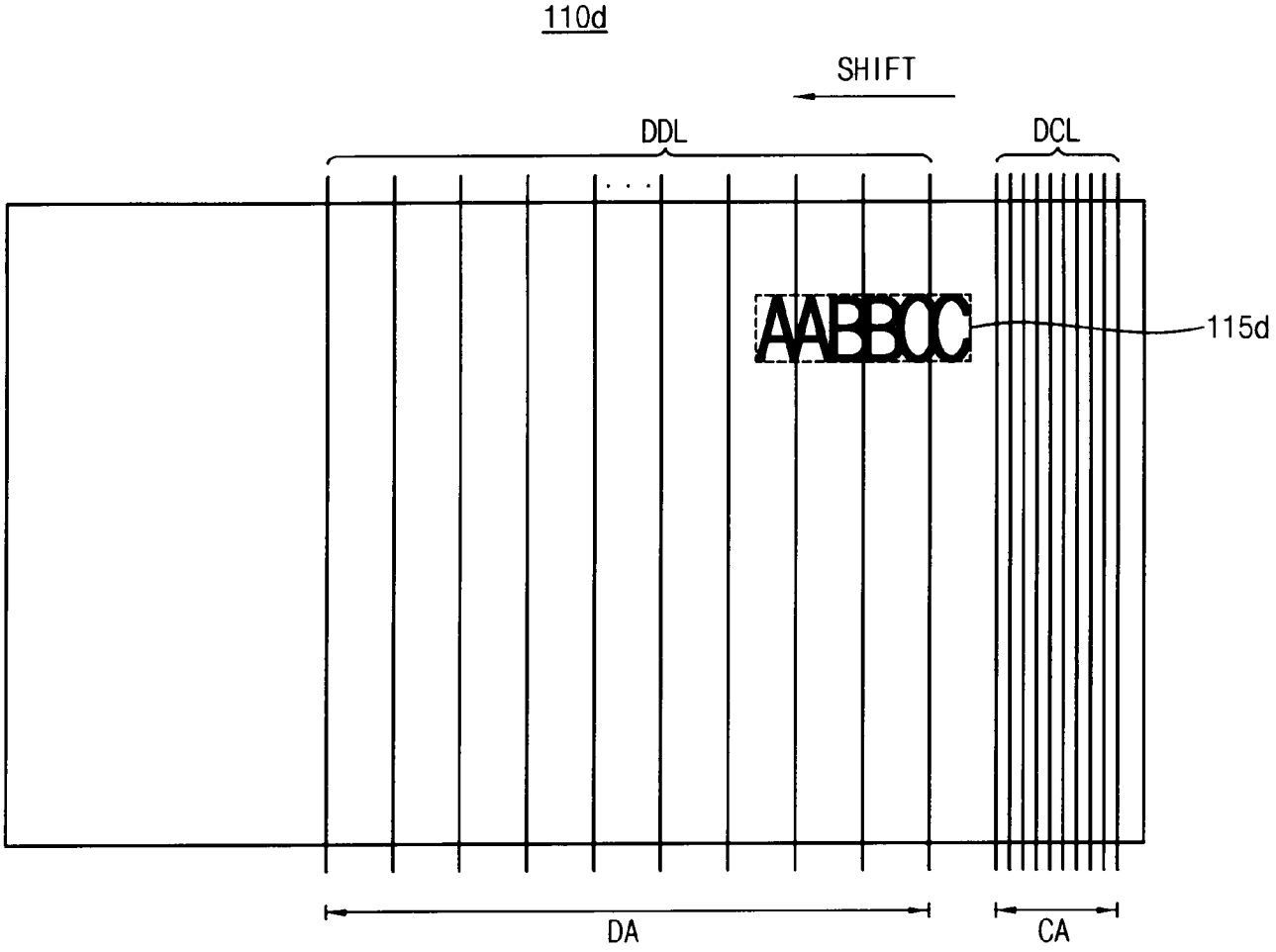
FIG. 6 is a diagram illustrating still another example when a static image block is shifted in a horizontal direction by the image correction unit in the display device of FIG. 1.

FIG. 4 is a diagram illustrating another example where a static image block is shifted in a horizontal direction by the image correction unit 120 in the display device 100 of FIG. 1. FIG. 5 is a diagram illustrating still another example where a static image block is shifted in a horizontal direction by the image correction unit 120 in the display device 100 of FIG. 1. FIG. 6 is a diagram illustrating still another example where a static image block is shifted in a horizontal direction by the image correction unit 120 in the display device 100 of FIG. 1.

Referring to FIGS. 4 to 6, the display panels 110*b*, 110*c* and 110*d* include a first region CA having a plurality of data insertion lines DCL and a second region DA having a plurality of data deletion lines DDL. The display panels 110*b*, 110*c* and 110*d* can include static image blocks 115*b*, 115*c* and 115*d*. The data insertion lines DCL and the data deletion lines DDL can be selected by the image correction unit 120.

The first region CA can include first through (k)th (k is a positive integer) data insertion lines DCL. In some embodiments, as illustrated in FIGS. 4 to 6, each of the data insertion lines DCL corresponds to at least a portion of a pixel column that is connected to a data line included in the first region CA. The second region DA can include first through (k)th data deletion lines DDL. In some embodiments, as illustrated in FIGS. 4 to 6, each of the data deletion lines DDL corresponds to at least a portion of a pixel column that is connected to a data line included in the second region DA. At least two of the data insertion lines DCL can be spaced apart from each other, and at least two of the data deletion lines DDL can be spaced apart from each other.

In some embodiments, the first to (k)th data insertion lines DCL1 through DCLk and first to (k)th data deletion lines DDL1 through DDLk are arranged in order. Shift regions in the display panels 110*a*, 110*b* and 110*c* can be between the first insertion line DCL1 and the (k)th deletion line DDLk.

A shift direction of the static image blocks 115*b*, 115*c* and 115*d* can correspond to a direction from the first region CA to the second region DA. Shift amounts of the respective pixel lines can be determined according to locations of the data insertion lines DCL and the data deletion lines DDL. The maximum shift amount of the pixel line can be k-pixels.

The static image blocks 115*b*, 115*c* and 115*d* can be shifted in the horizontal direction of the display panels 110*b*, 110*c* and 110*d*.

As illustrated in FIG. 4, the image correction unit 120 determines distances d11, d12 and d13 between the respective data insertion lines. For example, the distances d11, d12 and d13 are different from each other. The image correction unit 120 can determine distances d21 and d22 between the respective data insertion lines. The distances d21 and d22 can be different from each other. In some embodiments, the static image block 115*b* is located between the data insertion lines DCL and the data deletion lines DDL. In this case, a shift amount of the static image block 115*b* corresponds to the number of the data insertion lines DCL (or, the data deletion lines DDL). Thus, the static image block 115*b* can be shifted by k-pixels. The image correction unit 120 can generate the corrected image data DATA2 by rearranging the input image data DATA to shift the static image block 115*b* in a direction from the first region CA to the second region DA based at least in part on the inserted image data. In some embodiments, the respective inserted image data is generated by copying the input image data corresponding to the data insertion lines DCL. In some embodiments, the respective inserted image data is generated by copying the input image data corresponding to adjacent pixel lines respectively being adjacent to the data insertion lines DDL. The static image block 115*b* can be shifted in the right direction by k-pixels. In addition, the number of the data deletion lines DDL can be substantially the same as the number of the data insertion lines DCL, so that amount of deleted data can be substantially the same as amount of additionally inserted data. Thus, the corrected image without data loss in each pixel can be displayed on the display panel 110*b*. As a result, in some embodiments, an edge of the image on the screen is not cut, and the edge images on the display panel 110*b* are not distorted.

As illustrated in FIG. 5, the image correction unit 120 determines the respective data insertion lines DCL and data deletion lines DDL to correspond to portions of the respective pixel columns. The image correction unit 120 can generate the corrected image data DATA2 by rearranging the input image data DATA to shift the static image block 115*c* in a direction from the first region CA to the second region DA based at least in part on the inserted image data. The static image block 115*c* can be shifted in the right direction by the corrected image data DATA2. Shift amounts of some pixel lines in the static image block 115*c* can be different.

As illustrated in FIG. 6, the first region CA is arranged on the right side of the second region DA. In some embodiments, the static image block 115*d* is located between the data insertion lines DCL and the data deletion lines DDL. In some embodiments, as illustrated in FIG. 6, the data insertion lines DCL are located outside of the static image block 115*d* and at least one of the data deletion lines DDL at least partially overlaps the static image block 115*d*. The image correction unit 120 can generate the corrected image data DATA2 by rearranging the input image data DATA to shift the static image block 115*d* in a direction from the first region CA to the second region DA based at least in part on the inserted image data. The static image block 115*d* can be shifted in the left direction by the corrected image data DATA2. Shift amounts of some pixel lines in the static image block 115*d* can be different.

Figure 7:
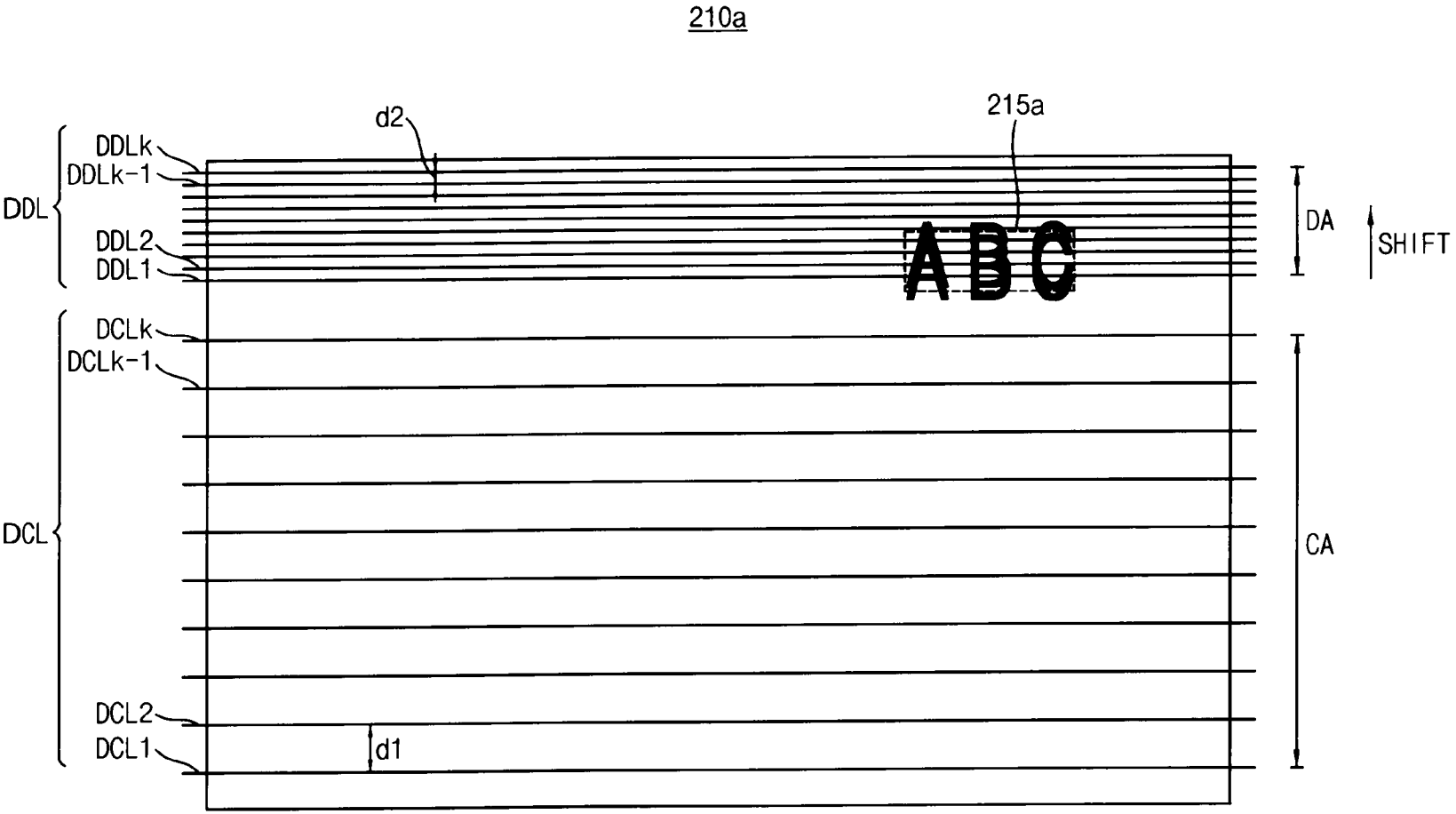
FIG. 7 is a diagram illustrating an example when a static image block is shifted in a vertical direction by the image correction unit in the display device of FIG. 1.
Figure 8:
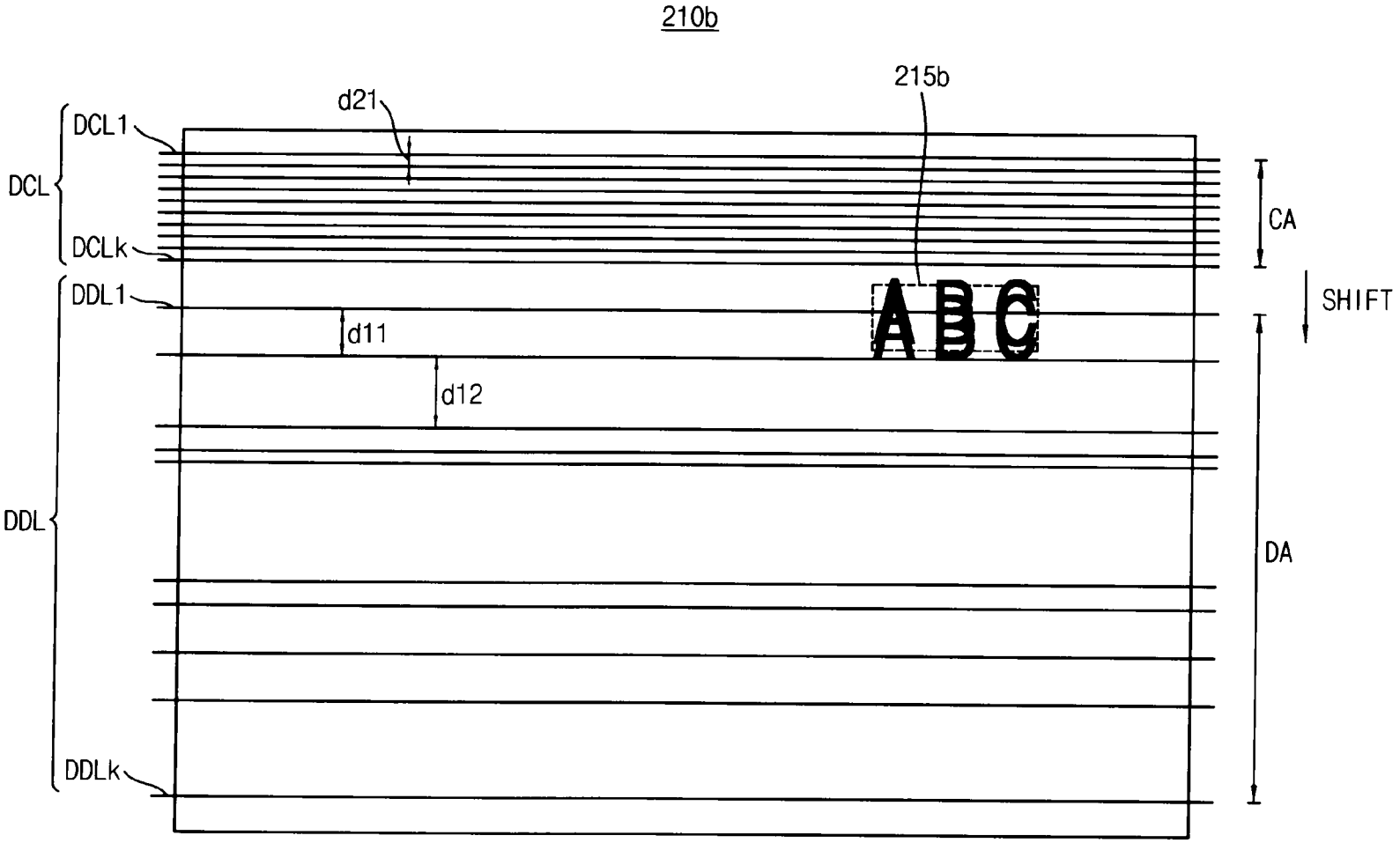
FIG. 8 is a diagram illustrating another example when a static image block is shifted in a vertical direction by the image correction unit in the display device of FIG. 1.

FIG. 7 is a diagram illustrating an example where a static image block is shifted in a vertical direction by the image correction unit 120 in the display device 100 of FIG. 1. FIG. 8 is a diagram illustrating another example where a static image block is shifted in a vertical direction by the image correction unit 120 in the display device 100 of FIG. 1.

Referring to FIGS. 1, 7, and 8, the image correction unit 120 shifts the static image block 215*a* and 215*b* in the vertical direction of the display panel 210*a* and 210*b*.

The display panel 210*a* and 210*b* can include a first region CA having a plurality of data insertion lines DCL and a second region DA having a plurality of data deletion lines DDL. The display panel 110*a* and 210*b* can include the static image block 215*a* and 215*b*. The data insertion lines DCL and the data deletion lines DDL can be selected by the image correction unit 120. In some embodiments, the first region CA can be arranged on an upper side of the second region DA or lower side of the second region DA.

The first region CA can include first through (k)th (k is a positive integer) data insertion lines DCL. Each of the data insertion lines DCL can correspond to at least a portion of a pixel row that is connected to a scan line included in the first region CA. The second region DA can include first through (k)th data deletion lines DDL. Each of the data deletion lines DDL can correspond to at least a portion of a pixel row that is connected to a scan line included in the second region DA. At least two of the data insertion lines DCL can be spaced apart from each other, and at least two of the data deletion lines DDL can be spaced apart from each other.

A shift direction of the static image block 215*a* and 215*b* can correspond to a direction from the first region CA to the second region DA. Shift amounts of the respective pixel lines can be determined according to locations of the data insertion lines DCL and the data deletion lines DDL. The maximum shift amount of the pixel line can be k-pixels. In some embodiments, a shift amount of the static image block corresponds to the number of the data insertion lines so that the shift amount of the static image block is k-pixels. The static image blocks 115*b*, 115*c* and 115*d* can be shifted in the vertical direction of the display panels 210*a* and 210*b*.

In some embodiments, the first to (k)th data insertion lines DCL1 through DCLk and first to (k)th data deletion lines DDL1 through DDLk are arranged in order. A shift region in the display panel 210*a* and 210*b* can be located between the first insertion line DCL1 and the (k)th deletion line DDLk.

As illustrated in FIG. 7, the image correction unit 120 determines locations of the data insertion lines DCL to be located on a lower side of the static image block 215*a* and locations of the data deletion lines DDL to be located on a upper side of the data insertion lines DCL. The image correction unit 120 can generate the corrected image data DATA2 to shift the static image by deleting first image data corresponding to the data deletion lines DDL into the input image data and inserting second image data corresponding to the data insertion lines DCL into the input image data. The static image block 215*a* can be shifted in the upper side direction of the display panel 210*a* by the corrected image data DATA2. Shift amounts of some pixel lines in the static image block 215*a* can be different.

As illustrated in FIG. 8, the image correction unit 120 determines locations of the data insertion lines DCL to be located on an upper side of the static image block 215*b* and locations of the data deletion lines DDL to be located on a lower side of the data insertion lines DCL. The image correction unit 120 can generate the corrected image data DATA2 to shift the static image by deleting first image data corresponding to the data deletion lines DDL into the input image data and inserting second image data corresponding to the data insertion lines DCL into the input image data. The static image block 215*b* can be shifted in the lower side direction of the display panel 210*b* by the corrected image data DATA2. Shift amounts of some pixel lines in the static image block 215*b* can be different. In some embodiments, distances d11 and d12 between the respective data deletion lines DDL can be different. Distances between the respective data deletion lines DCL can be different.

Figure 9:
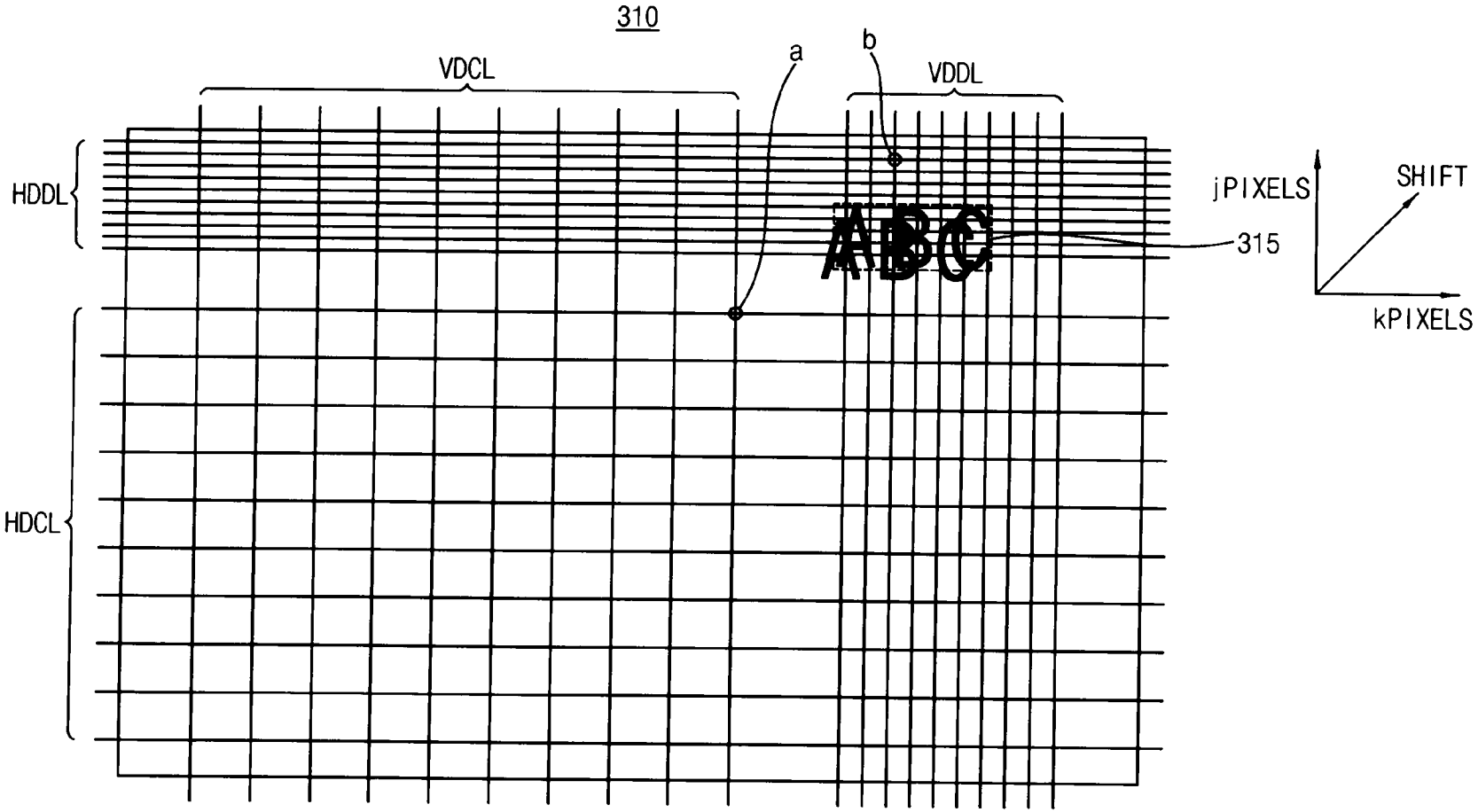
FIG. 9 is a diagram illustrating an example when a static image block is shifted in a diagonal direction by the image correction unit in the display device of FIG. 1.

FIG. 9 is a diagram illustrating an example where a static image block is shifted in a diagonal direction by the image correction unit 120 in the display device 100 of FIG. 1.

Referring to FIGS. 1 and 9, the image correction unit 120 shifts the static image block 315 in the diagonal direction of the display panel 310.

The display panel 310 can include k (k is an integer greater than 1) numbers of first data insertion lines VDCL and j (j is an integer greater than 1) numbers of second data insertion lines HDCL. Each of the first data insertion lines VDCL can correspond to at least a portion of a pixel column that is connected to a data line. Each of the second data insertion lines HDCL can correspond to at least a portion of a pixel column that is connected to a scan line.

The display panel 310 can further include k numbers of first data deletion lines VDDL and j numbers of second data deletion lines HDDL. Each of the first data deletion lines VDDL can correspond to at least a portion of a pixel column that is connected to a data line. Each of the second data deletion lines HDDL can correspond to at least a portion of a pixel column that is connected to a scan line.

A shift direction of the static image block 315 can correspond to a direction from the data insertion lines to the data deletion lines. A shift amount of the static image block 315 can be determined according to locations of the data insertion lines and the data deletion lines. As illustrated in FIG. 9, the static image block 315 is shifted in the right direction by the first data insertion lines VDCL and the first data deletion lines VDDL. In some embodiments, the static image block 315 is also shifted in the upper direction by the second data insertion lines HDCL and the second data deletion lines HDDL. For example, the static image block 315 is shifted in the right direction by k-pixels and shifted in the upper direction by j-pixels. As a result, the static image block 315 can be shifted in the diagonal direction of the display panel 310 by corrected image data DATA2.

However, an image data corresponding to an intersection pixel (e.g., 'a' point of FIG. 9) where one of the first data insertion lines VDCL and one of the second data insertion lines HDCL are crossed can be repeatedly inserted in one frame such that the image correction unit 120 can further delete the image data corresponding to the intersection pixel. Similarly, the image correction unit 120 can further insert certain image data corresponding to an intersection pixel (e.g., 'b' point of FIG. 9) where one of the first data deletion lines VDDL and one of the second data deletion lines HDDL are crossed. In some embodiments, the image correction unit 120 determines various data insertion line patterns and data deletion lines patterns such as polygonal patterns, circular patterns, elliptical pattern, etc, and shift the static image block.

As described above, the display device 100 according to example embodiments selects the data insertion lines and the data deletion lines and generate the corrected image data DATA2 to shift a portion of the whole image including the static image block 115. At least two of the data insertion lines can be spaced apart from each other, and at least two of the data deletion lines can be spaced apart from each other. Thus, the display device 100 can control the shift direction and the shift amount of the static image 115 according to the locations of the data insertion lines and the data deletion lines. Therefore, a problem where an edge of the image in the screen is cut and distortion of the edge image by typical image shift method can be improved. Further, an afterimage and degradation of the pixels due to the continuous display of the same image such as a logo, titles, etc., can be efficiently prevented.

Figure 10:
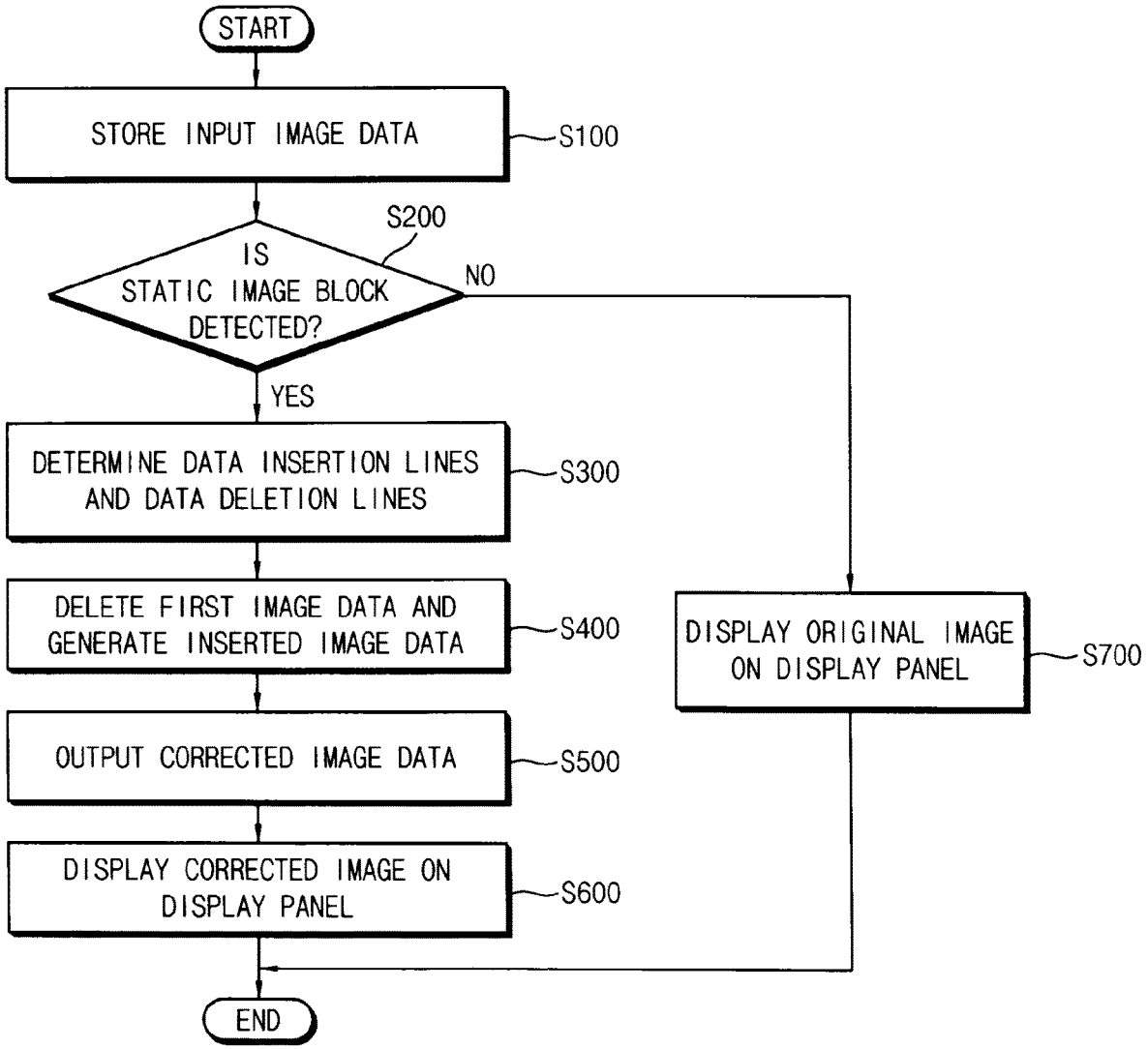
FIG. 10 is a flowchart of a method for correcting image of the display device according to example embodiments.

FIG. 10 is a flowchart of a method for correcting image of the display device 100 according to example embodiments.

In some embodiments, the FIG. 10 procedure is implemented in a conventional programming language, such as C or C++ or another suitable programming language. The program can be stored on a computer accessible storage medium of the display device 100, for example, a memory (not shown) of the display device 100 or the timing controller 150. In certain embodiments, the storage medium includes a random access memory (RAM), hard disks, floppy disks, digital video devices, compact discs, video discs, and/or other optical storage mediums, etc. The program can be stored in the processor. The processor can have a configuration based on, for example, i) an advanced RISC machine (ARM) microcontroller and ii) Intel Corporation's microprocessors (e.g., the Pentium family microprocessors). In certain embodiments, the processor is implemented with a variety of computer platforms using a single chip or multichip microprocessors, digital signal processors, embedded microprocessors, microcontrollers, etc. In another embodiment, the processor is implemented with a wide range of operating systems such as Unix, Linux, Microsoft DOS, Microsoft Windows 8/7/Vista/2000/9x/ME/XP, Macintosh OS, OS X, OS/2, Android, iOS and the like. In another embodiment, at least part of the procedure can be implemented with embedded software. Depending on the embodiment, additional states can be added, others removed, or the order of the states changed in FIG. 10. The description of this paragraph applies to the embodiment shown in FIG. 11.

Referring to FIGS. 1 and 10, the method for correcting image of the display device 100 includes receiving and storing an input image data DATA from an external device (S100) and detecting the static image block 115 among an image displayed on the display panel 110 based at least in part on the input image data DATA accumulated within a predetermined time (S200). The method also includes determining the data insertion lines and the data deletion lines among the pixel lines extending in a first direction included in the display panel when the static image block 115 is detected (S300) and deleting first image data corresponding to the data deletion lines from the input image data DATA and generating inserted image data of second image data corresponding to the data deletion lines from the input image data DATA (S400). At least two of the data insertion lines can be spaced apart from each other, and at least two of the data deletion lines can be spaced apart from each other. The method can further include outputting corrected image data DATA2 by rearranging the input image data DATA to shift the static image block 115 based at least in part on the inserted image data (S500) and displaying a corrected image having a shifted static image block 115 on the display panel 110 based at least in part on the corrected image data DATA2 (S600). An original image corresponding to image data DATA1 converted from the input image data DATA can be displayed on the display panel 110 when the static image block 115 is not detected (S700).

In some embodiments, the display panel 110 includes a first region CA having the data insertion lines and a second region DA having the data deletion lines. A shift direction of the static image block 115 can correspond to a direction from the first region CA to the second region DA. For example, the static image block 115 is shifted in the right direction when the first region CA is in the left side from the second region DA. A shift amount of the static image can correspond to the number of the data insertion lines, and the number of the data insertion lines can be substantially the same as the number of the data deletion lines.

In some embodiments, the first direction corresponds to a direction in which a data line transmitting a data signal is extended or a direction in which a scan line transmitting a scan signal is extended. However, the first direction is not limited thereto.

Since details of correcting an image of the display device 100 related to the steps S100 to S700 are described above in reference to FIGS. 1 through 9, duplicate descriptions will not be repeated.

Figure 11:
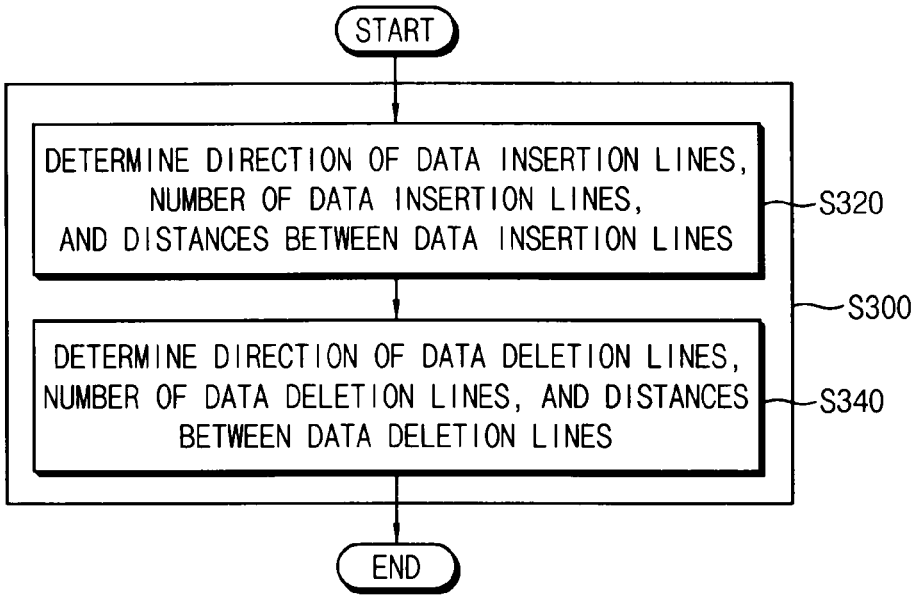
FIG. 11 is a flowchart illustrating an example of the method for correcting image of FIG. 10.

FIG. 11 is a flowchart illustrating an example of the method for correcting an image of FIG. 10.

Referring to FIGS. 1 to 11, the method of determining the data insertion lines and the data deletion lines (S300) can include determining a direction of the data insertion lines, the number of the data insertion lines, and distances between the respective data insertion lines (S320), and determining a direction of the data deletion lines, the number of the data deletion lines, and distances between the respective data deletion lines (S340).

The directions of the data deletion lines and the data insertion lines can correspond to a direction in which a data line transmitting a data signal is extended or a direction in which a scan line transmitting a scan signal is extended. The number of the data insertion lines can be substantially the same as the number of the data deletion lines. Here, distances between respective data deletion lines and distances between respective data insertion lines can be substantially the same. In some embodiments, the determining operations are set by a user who uses a remote controller or a similar key entry unit.

Further, the user can further set shift patterns of the static image block 115 and a period of time for determining whether the static image block 115.

Since details for correcting an image of the display device 100 related to the steps S100 to S700 are described above in reference to FIGS. 1 through 9, duplicate descriptions will not be repeated.

The present embodiments can be applied to any display device and any system including the display device. For example, the present embodiments are applied to televisions, computer monitors, laptops, digital cameras, cellular phones, smartphones, smart pads, personal digital assistants (PDAs), portable multimedia players (PMPs), MP3 players, navigation systems, game consoles, video phones, etc.

The foregoing is illustrative of example embodiments, and is not to be construed as limiting thereof. Although a few example embodiments have been described, those skilled in the art will readily appreciate that many modifications are possible in the example embodiments without materially departing from the novel teachings and advantages of example embodiments. Accordingly, all such modifications are intended to be included within the scope of example embodiments as defined in the claims. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims. The inventive concept is defined by the following claims, with equivalents of the claims to be included therein.

What is claimed is:

1. A display device, comprising:

a display panel including a plurality of pixel lines extending in a first direction, wherein each pixel line of the plurality of pixel lines includes a plurality of pixels;

an image corrector configured to i) receive input image data, ii) select a first portion of the plurality of pixel lines as a plurality of data insertion pixel lines and a second portion of the plurality of pixel lines as a plurality of data deletion pixel lines, wherein the input image data represents an image including an input static image block, iii) insert second image data corresponding to the plurality of data insertion pixel lines into the input image data, and iv) delete first image data corresponding to the plurality of data deletion pixel lines from the input image data so as to generate corrected image data including a shifted static image block where the input static image block is shifted, wherein the plurality of data insertion pixel lines comprise at least two data insertion pixel lines that are spaced apart from each other such that at least one first pixel line from among the plurality of pixel lines is disposed between the at least two data insertion pixel lines, wherein the plurality of data deletion pixel lines comprises at least two data deletion pixel lines that are spaced apart from each other such that at least one second pixel line from among the plurality of pixel lines is disposed between the at least two data deletion pixel lines, and wherein at least one of distances between immediately adjacent data deletion pixel lines is different from distances between immediately adjacent data insertion pixel lines;

a scan driver configured to provide a scan signal to the display panel;

a data driver configured to provide a data signal corresponding to the corrected image data to the display panel; and a timing controller configured to control the scan driver and the data driver.

2. The display device of claim 1, wherein the image corrector is further configured to determine shift amounts of the input static image block based at least in part on locations of the plurality of data insertion pixel lines and the plurality of data deletion pixel lines.

3. The display device of claim 1, wherein a number of the plurality of data deletion pixel lines is the same as a number of the plurality of data insertion pixel lines.

4. The display device of claim 3, wherein the image corrector is further configured to select a first data insertion pixel line to a (k)th data insertion pixel line as the plurality of data insertion pixel lines and a first data deletion pixel line to a (k)th data deletion pixel line as the plurality of data deletion pixel lines, where k is an integer greater than 1, wherein the plurality of data insertion pixel lines and the plurality of data deletion pixel lines are arranged in order, and wherein an image shift region in the display panel is located between the first data insertion pixel line and the (k)th data deletion pixel line.

5. The display device of claim 3, wherein the input static image block is located between the plurality of data insertion pixel lines and the plurality of data deletion pixel lines.

6. The display device of claim 5, wherein a shift amount of the input static image block corresponds to the number of the plurality of data insertion pixel lines.

7. The display device of claim 3, wherein the plurality of data insertion pixel lines are located outside of the input static image block, and wherein at least one of the plurality of data deletion pixel lines at least partially overlaps the input static image block.

8. The display device of claim 1, wherein the display panel includes a first region having the plurality of data insertion pixel lines and a second region having the plurality of data deletion pixel lines, and wherein a shift direction of the input static image block extends from the first region to the second region.

9. The display device of claim 8, wherein the image corrector includes:

a memory configured to store the input image data from a device external to the display device;

a static image detector configured to detect the input static image block within the image based at least in part on the input image data;

a determiner configured to select the plurality of data insertion pixel lines and the plurality of data deletion pixel lines based at least in part on a location of the input static image block; and a corrected image data generator configured to i) delete the first image data, ii) generate a third image data including the second image data, and iii) shift the input static image block in the first direction based at least in part on the third image data so as to output the corrected image data.

10. The display device of claim 9, wherein the corrected image data generator is further configured to copy the input image data corresponding to the plurality of data insertion pixel lines so as to generate the third image data.

11. The display device of claim 9, wherein the determiner is further configured to periodically determine at least one of: a direction of the plurality of data insertion pixel lines, a number of the plurality of data insertion pixel lines, the distances between the immediately adjacent data insertion pixel lines, a direction of the plurality of data deletion pixel lines, a number of the plurality of data deletion pixel lines, and the distances between the immediately adjacent data deletion pixel lines.

12. The display device of claim 1, wherein the first direction corresponds to a direction in which a data line configured to transmit the data signal extends.

13. The display device of claim 1, wherein the first direction corresponds to a direction in which a scan line configured to transmit the scan signal extends.

14. The display device of claim 1, wherein the timing controller includes or is electrically connected to the image corrector.

* * * * *